US006378727B1

(12) United States Patent
Dupuis et al.

(10) Patent No.: US 6,378,727 B1
(45) Date of Patent: Apr. 30, 2002

(54) DEVICE FOR DISPLAYING AND DISPENSING A PLURALITY OF PRODUCTS

(75) Inventors: Michel Dupuis, Courteuil; Véronique Guillemain, Nanterre, both of (FR)

(73) Assignee: Bourjois, Sur-Seine (FR)

( * ) Notice: Subject to any disclaimer, the term of this patent is extended or adjusted under 35 U.S.C. 154(b) by 0 days.

(21) Appl. No.: 09/673,639

(22) PCT Filed: Apr. 29, 1999

(86) PCT No.: PCT/FR99/01025

§ 371 Date: Jan. 8, 2001

§ 102(e) Date: Jan. 8, 2001

(87) PCT Pub. No.: WO99/56593

PCT Pub. Date: Nov. 11, 1999

(30) Foreign Application Priority Data

Apr. 30, 1998 (FR) ..... 98 05535

(51) Int. Cl.[7] ..... B65G 59/00
(52) U.S. Cl. ..... 221/92; 211/59.3
(58) Field of Search ..... 221/92, 69, 131, 221/130, 289; 211/59.3, 43, 51

(56) References Cited

U.S. PATENT DOCUMENTS 5,027,957 A 7/1991 Skalski
5,261,208 A 11/1993 Lockhart
5,685,664 A 11/1997 Parham et al.

FOREIGN PATENT DOCUMENTS

| | | |
|---|---|---|
| DE | 262351 | 8/1912 |
| FR | 8004100 | 10/1936 |
| GB | 2 290 077 | 12/1995 |
| GB | 2 297 241 | 7/1996 |
| WO | 91 15141 | 10/1991 |

*Primary Examiner*—Kenneth W. Noland
(74) *Attorney, Agent, or Firm*—Hunton & Williams

(57) ABSTRACT

The invention relates to a display (20) comprising a package pusher (44) operated by a coiled spring (56, 103) and slidable within a slot (64) to push packages (36) forward to the front of a shelf (22), the pusher being laterally movable to accommodate various sized packages at various lateral positions along the shelf. The pusher is a part of a feed structure having ends engaging vertical grooves (26, 30) in upstanding walls (24, 28) fore and aft of the shelf and forming a part of a dispensing tray. The tray may be formed of laterally connected modules. Lateral displacement of the package pusher to accommodate various sized packages and positioning thereof may be accommodated by the provision of laterally spaced slots (101) within a shelf (22) having a forward wall to catch the forward-most package.

16 Claims, 17 Drawing Sheets

DEVICE FOR DISPLAYING AND DISPENSING A PLURALITY OF PRODUCTS

A subject of the invention is a device for displaying and dispensing a plurality of products with the same format or outline, in particular in the field of cosmetics or parapharmaceuticals.

One of the ways of selling these products is the self-service method, in particular, in general or specialist hypermarkets.

In self-service sales areas, the products are usually displayed either on a more or less flat or slightly inclined surface or along a vertical wall.

The more or less flat configuration corresponds to the case in which the products to be sold are displayed on a table or on shelves arranged on a gondola. As a general rule, when in particular products of a relatively small size, such as cosmetics, are involved, these products are commonly displayed by means of a specific display unit made from moulded plastic material having a horizontal surface overall in which pockets are arranged each intended to house a sample of a product. Thus, for example, there are cylindrical pockets of small diameter for oblong products such as, for example, lipstick tubes and above all for products such as mascara tubes. Recesses or steps can be provided for housing rows of relatively flat products such as compacts for make-up or foundation. Less deep pockets are also provided for housing the lower part of products of more complex shape, for example, bottles of nail varnish.

Such a display unit contributes to the highlighting of products offered for sale. However, the effectiveness of this highlighting can deteriorate quite rapidly as soon as customers take products from their pockets, if only to see all the products such as tubes of lipstick or mascara, and do not replace them in the right place, for example laying them flat between several pockets. This produces a disorganized appearance which definitely disrupts the sought overall aesthetic effect. Similarly, as the products offered for sale are taken by customers, the display unit is depleted, thus progressively giving an impression of emptiness. To overcome these drawbacks of disorganization and emptiness, it is necessary for the sales staff to regularly restock the empty pockets and replace the incorrectly placed products.

The same drawbacks can be found regarding parapharmaceutical products when care is taken with the display and a specific display unit is provided to this end.

When the available surface is a more or less vertical panel, be it a gondola panel or a wall panel, products are commonly displaced by means of a system of more or less parallel hooks arranged perpendicular to the available surface. Such an arrangement of course means that the products offered for sale have been packaged in blister packs, i.e. by means of packaging in plastic material having a general rectangular shape preventing any direct handling of the products by customers.

In this vertical configuration, the effect of emptiness can be a little less significant inasmuch as in practice, each hook carries a succession of similar products such that the removal by a customer of the most accessible product reveals that located directly behind. However, the impression of holes corresponding to the space left by the product which has been taken, persists. It is therefore common for the sales staff to be obliged to bring to the front in a very accessible configuration the products remaining at the back, near to the vertical wall itself.

There can also be mentioned a very old configuration of a display and dispensing unit for products described in the document FR-804 100 published in 1936; this unit comprises compartments divided into stacked rows and in which products are arranged one behind the other being pushed forwards by a spring. The front end of each compartment is free, making it easy to grip of forward most product due to the fact that the compartment of the level directly above is set back.

However, such a configuration has the drawback in particular that the proximity of the compartments prevents the products from being appreciated individually from a visual point of view; in addition, the bevelled shape of the front of the unit, necessary for a good grip of the products, gives the displayed products an overall terraced configuration which reinforces the impression of accumulation; yet this bevelled shape prevents the use of available space from being optimized (the upper compartments contain fewer products than those below, unless the loss of the rear space of the lower compartment is accepted) finally, this stand appears to be suitable only for products with a simple shape.

A subject of the invention is to overcome the aforementioned drawbacks thanks to a display and dispensing device which combines the possibility of displaying the products, each individually and more or less in its entirety, the automatic replacement of a product which a customer has just taken by another of the same type (whilst still allowing, in the contrary case, the reintroduction of this product), with a minimization of the risks of jamming, but in an optimal state of cleanliness, whilst optimizing the use of the available volume without however detracting from the overall aesthetic effect through an effect of accumulation and without having to be restricted to products of a simple shape.

To this end, the invention proposes a device for displaying and dispensing a plurality of products of the same format, in particular in the field of cosmetics or parapharmaceuticals, comprising:

- a front panel pierced by at least one opening shaped to allow a product through;
- a housing element connected to the front panel in front of each opening, shaped so as to be able to house and hold the lower part of a product;
- a guide element lying perpendicular to the front panel and connected to the front panel behind each opening and shaped so as to hold, with clearance, the products from below, from above and on the sides;
- a pusher engaged with clearance in the guide element and shaped so as to be able to be held by this element from below, from above and on the sides;
- an elastic means forcing the pusher towards the opening.

Thus defined, the invention is characterized in particular vis-à-vis document FR-804 100 by the fact that there is a front panel pierced by openings behind which are arranged guide elements and a housing element in front of this panel opposite each guide element. The panel constitutes a type of base on which each product can be distinguished visually in an individual manner. The display in front of the panel allows the guide elements to be perpendicular to this panel which allows an optimal usage of the available space (the guide elements can be the same length, the whole occupying a volume which is more or less parallelepiped). The panel allows an optimal masking of the guide elements arranged at the back, in particular thanks to the fact that the openings are shaped as function of the product and can thus very closely resemble the outline of the latter. The appropriate shaping of the guide elements and, if need be, of the pusher allows a correct progression of the products, even in the case of products with a complex shape. Finally, the shaping of the housing element (separate from the guide element) as a function of the shape of the product allows a good display of each product, as it is possible to take the shape of the product into account both at the front and the sides. It can be noted here that added to the risk of jamming due to the thrust exerted on a collection of products of complex shape (bottles of varnish) possibly tapered (tubes of mascara) and/or provided with external reliefs (lipsticks provided with a gripping ring for example) there was a priori for a person skilled in the art, the risk of a very variable (and probably unattractive) display of the products at the exit of the guide element, failing provision being made for keeping the object in position over a very large part of its surface (in particular its height), thus rendering it almost impossible for the customer to take hold of the object and release it. It has however been found that by giving an optional inclination to the support surface of the pusher (or to parts of it) and by optionally making the section of the guide element to be quite similar in shape to the outline of the objects to be displayed, it was possible to safely bring each of the objects successively through the opening in the housing element, and that it was not necessary to provide for a support for the objects over a large part of their surface, and that it was sufficient for example, with regard to objects as oblong as tubes of mascara, to hold them over a height of just a quarter to a third without this posing a problem even in the case of the reintroduction of products.

According to preferred characteristics of the invention, optionally combined:

- the housing element comprises a lateral wall made form a more or less transparent material; this allows the whole product to be seen, and from several angles;
- the housing element is connected to the front panel by its base wall;
- this device comprises several identical openings and housing elements and guide elements in numbers equal to those of these openings;
- each opening has a section similar, clearances apart, to the format of the product considered;
- this guide element is made of transparent material; it is for example a section; this allows the remaining products to be counted without detracting from the attractiveness of the whole since this element is hidden by the front panel;
- this guide element has more or less the same internal section as the opening to which it is connected;
- the pusher has a front surface formed from portions having different inclinations chosen as a function of the format of the product such that the product which is located in the housing element is more or less parallel to the front panel in the same orientation as the opening;
- in the case where the product has a shape which broadens upwards from a narrow zone, the front surface of the pusher has a portion inclined upwards and rearwards;
- the elastic means is subjected to tensile stress;
- the elastic means comprises at least one spring sheet wound in a spiral which runs alongside the guide element and one end of which is fixed at least temporarily at the opening; this spring sheet can run alongside the products from below, also from above and/or on one side;
- this elastic means can comprise a second spring sheet the rear end of which is linked to a removable element which can be, as required, hooked on to the piston or to a rear portion of the guide element; this aspect original in itself can be used, in fact, independently of the presence or not of the front panel and the housing element;
- this spring sheet rests on the back of a portion (for example the lower) of the pusher; to this end, this portion advantageously comprises a wall provided with a transverse slit for the passage of the spring sheet;
- the pusher is provided with at least one rib intended to be guided by the guide element.

The invention also proposes a display unit comprising a plurality of devices of the above-mentioned type, some at least of these devices having front panels of the same dimensions. Such a display unit is thus modular and the locations of the devices can be easily transposed.

Objects, characteristics and advantages of the invention are apparent from the description which follows, given as a non-limitative example with reference to the attached drawings in which:

FIGS. 1 to 19 show the totality, or details, of a device, numbered 100 in its entirety intended for displaying and dispensing tubes of mascara designated under the reference 1.

Figure 1:
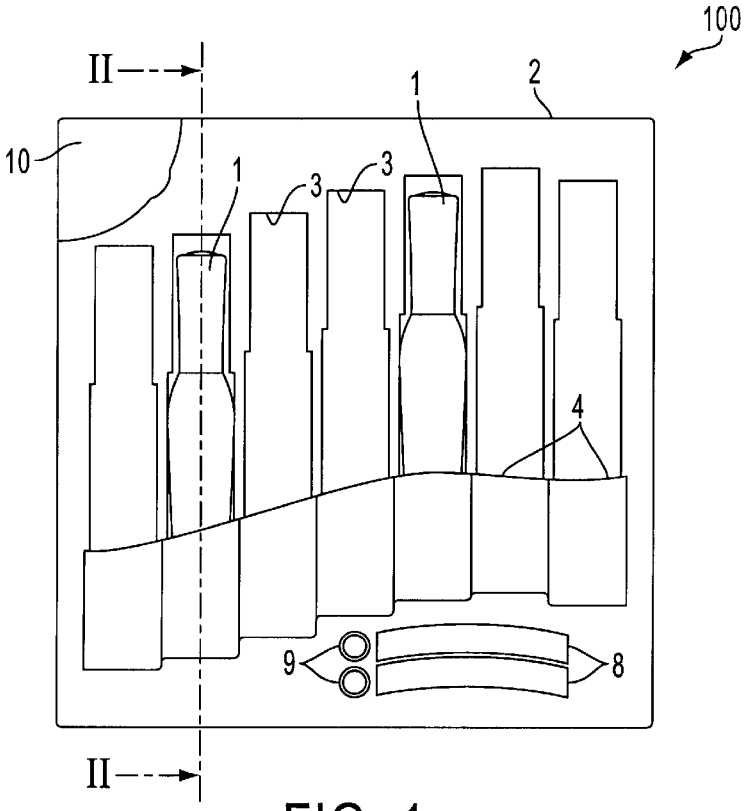
FIG. 1 is front view of a device for displaying and dispensing products according to the invention, in the case of tubes of mascara.
Figure 2:
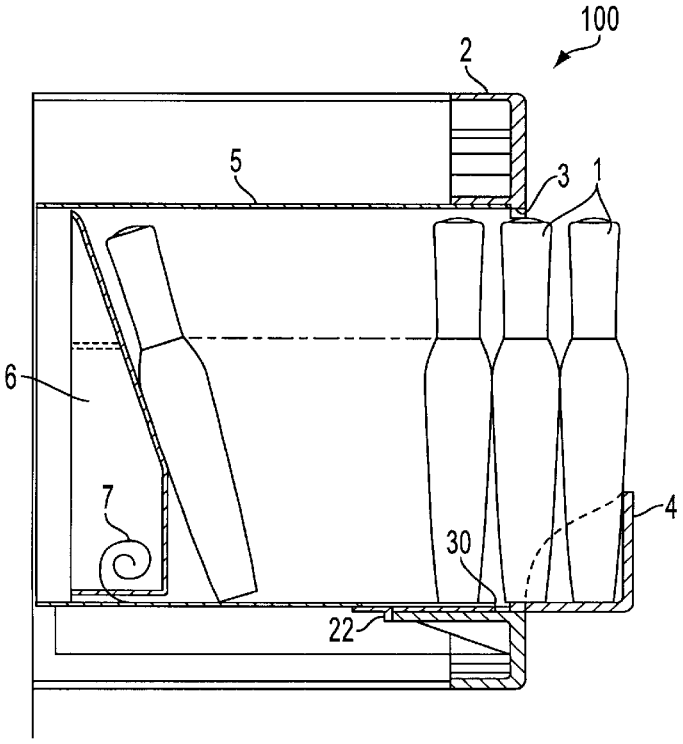
FIG. 2 is a sectional view of this device along line II—II of FIG. 1.
Figure 16:
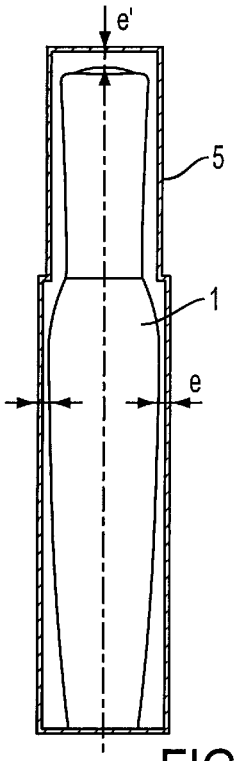
FIG. 16 is a detailed view showing a guide element containing a tube of mascara.

In a standard manner, these tubes of mascara are very elongated (tapered) objects, i.e. they are objects the largest dimension of which, here the vertical dimension, is much greater than its two other dimensions, namely its width in the plane of FIG. 1 or 16 and its width in the plane of FIG. 2. In the case under consideration, the height of the tubes of mascara is five times greater than its maximum width.

As is apparent from FIGS. 1 and 2, the device 100 essentially comprises a front panel 2 in which at least one opening 3 is arranged, a housing element 4 arranged in front of the front panel opposite the lower part of each opening, a guide element 5 arranged behind each opening, a pusher 6 engaged in this guide element and an elastic return element 7 elastically forcing this pusher 6 towards the opening.

In the example under consideration, the device 100 is adapted for displaying and dispensing seven tubes of mascara at one time.

For reasons of compactness, the openings 3 corresponding to each column of tubes of mascara are arranged in an adjacent manner. In contrast, their relative positions as regards height are completely arbitrary, and so, in the example under consideration, starting from the left end, the level of the openings rises until the penultimate opening then drops for the last one. As a variant, the height can remain constant or display any other pattern.

There can be, in addition to these openings 3 intended for tubes of mascara, openings intended for other products. It is thus that in the example shown, two openings 8 of any arbitrary shape, here upward-rounded slits, are provided to allow the insertion of pencils. By these openings 8 are arranged openings 9 intended to receive, as a tester product, a pencil; these openings 9 are thus circular in shape with a section barely greater than that of such as pencil.

There can also be an area, here marked under the reference 10, for the insertion of any supporting publicity message which is not shown.

The front panel is shown in more detail in FIGS. 5 to 11.

Figure 5:
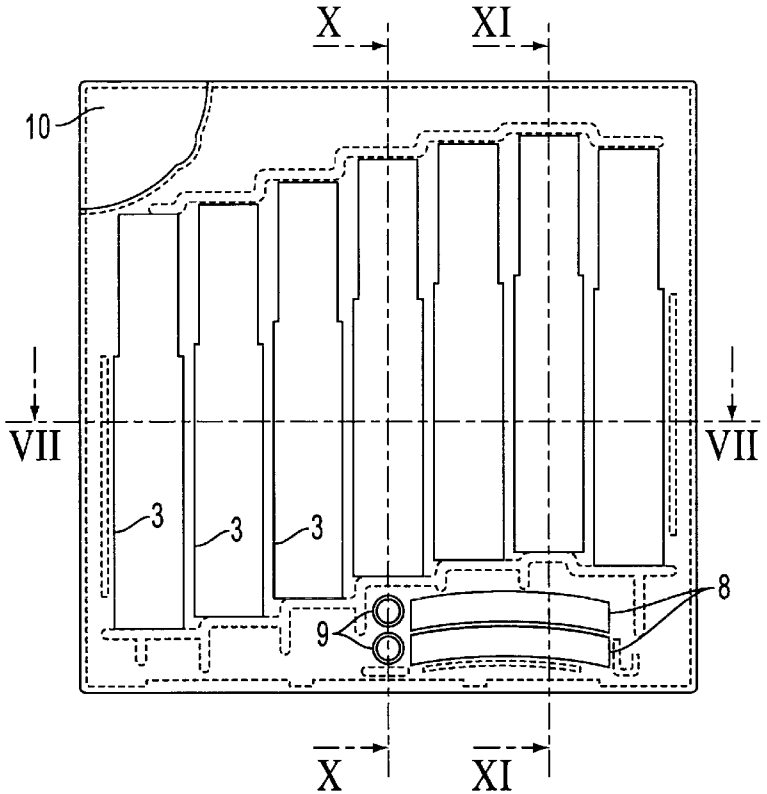
FIG. 5 is a front view of the front panel of the device.
Figure 7:
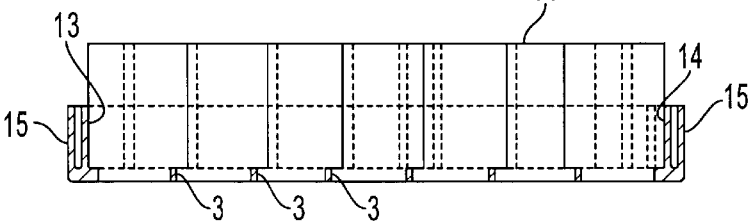
FIG. 7 is a transverse sectional view of the front panel along line VII—VII of FIG. 5.

In FIG. 5, there are seven openings 3. These openings are identical as they are intended the passage of identical products.

In the example under consideration, the shape of these openings 3 has a simple geometric section similar, clearances apart, the outline of the tube of mascara under consideration. More precisely, the openings 3 are here the result of the superimposition of two narrow rectangles, the upper rectangle being slightly narrower than the lower rectangle, the upper rectangle having a section slightly greater than the upper part of the tube of mascara, in this case its cap, whilst the lower part has a section slightly larger than the bottom part of this tube in this case the actual body of this tube.

It should be noted that the height of this opening is slightly greater than the height of the tubes of mascara so as to allow, with clearance, the passage of this tube.

As indicated previously, this front 2 comprises openings 8 and 9 as well as an area 10 for holding, for example, a publicity message.

Figure 37:
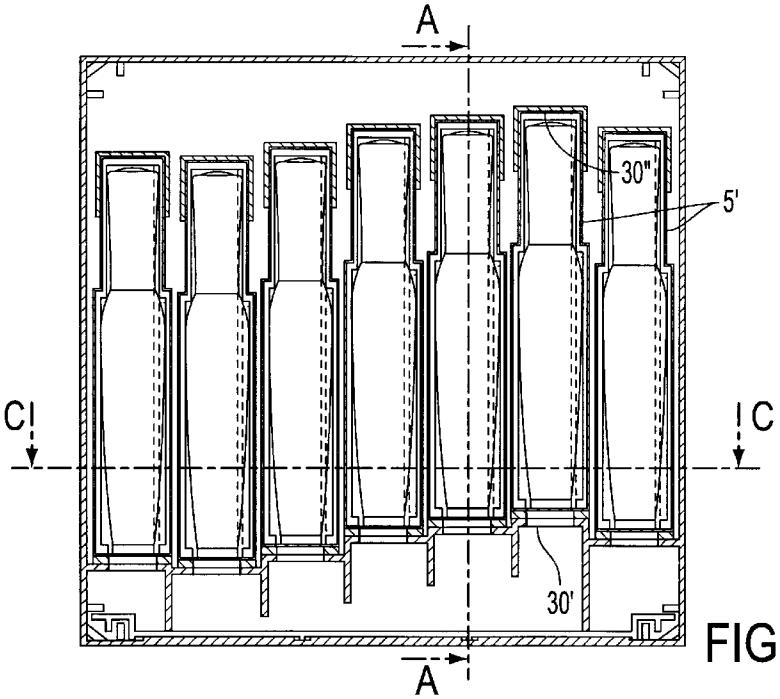
FIG. 37 is a sectional view along line B—B of FIG. 39 of a variant of the device for displaying and dispensing tubes of mascara.
Figure 38:
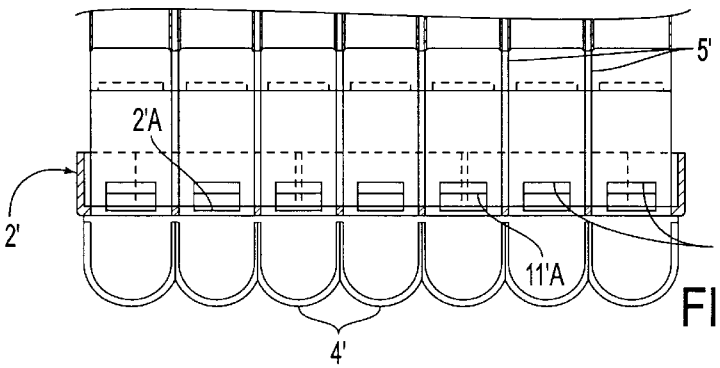
FIG. 38 is a partial sectional view along line C—C of FIG. 37.

For a precise positioning of the guide elements 5 at the rear of the front panel relative to the openings 3, this front panel 2 advantageously comprises, on its rear surface, lower ribs 11, upper ribs 12 and lateral ribs 13 and 14. When, as will be apparent later with regard to FIG. 15, the guide elements 5 are gathered together in a rigid assembly, it suffices, for the precise positioning of all guide elements, to have a single lower stop and a single upper stop. However, above all when the guide elements are independent (cf. FIGS. 37 and 38), it is preferable that the lower ribs 11 and upper ribs 12 serve as a support for each of the guide elements, which contributes to the solidity of the assembly.

To this end, the lower rib 11 comprises a number of steps 11A, 11B etc each corresponding to the lower section of one of the guide elements whilst the upper rib 12 similarly comprises, for each guide element, support steps 12A, 12B, etc.

Insofar as the lower ribs 11 and upper ribs 12 can have different mechanical roles, they can have, perpendicular to the plane of the front panel, different dimensions.

It is thus that, insofar as the lower rib 11 is capable of participating in taking the weight of the guide elements and tubes of mascara which they contain, a mechanical function which does not exist for the upper rib, this lower rib 11 advantageously has, perpendicular to the plane of the front panel, a dimension greater than that of the upper rib. It can thus be seen, in FIG. 9 to 11, that the lower rib 11 has, perpendicular to the plane of the front panel, a dimension more or less equal to twice that of the upper rib 12. In fact, to stiffen the front panel 2, this advantageously comprises, all around its perimeter, an edge 15, the dimension perpendicular to the front panel of which is more or less equal to that of the upper rib.

Figure 11:
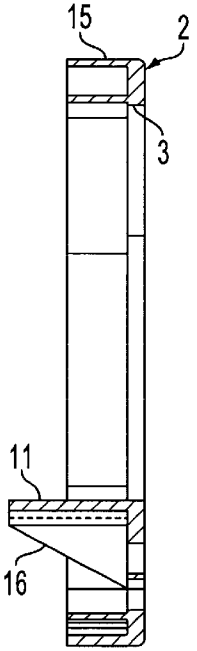
FIG. 11 is a sectional view of this same panel along section line XI—XI of FIG. 5.
Figure 10:
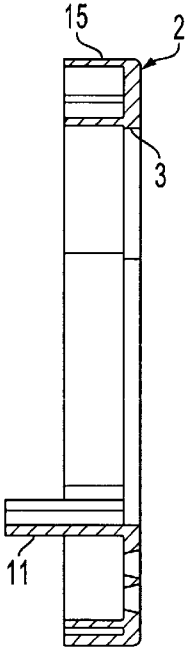
FIG. 10 is a sectional view of this panel along line X—X of FIG. 5.
Figure 9:
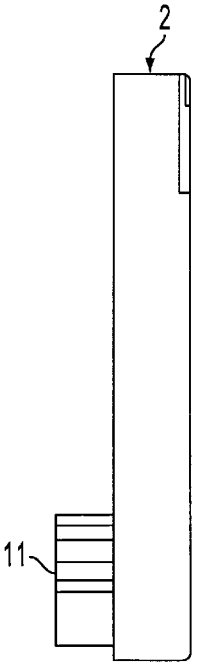
FIG. 9 is a side view of the front panel.

In addition, to improve the mechanical resistance of the lower rib, this is advantageously provided with a stiffening bracket 16, seen in particular in FIG. 11.

Figure 6:
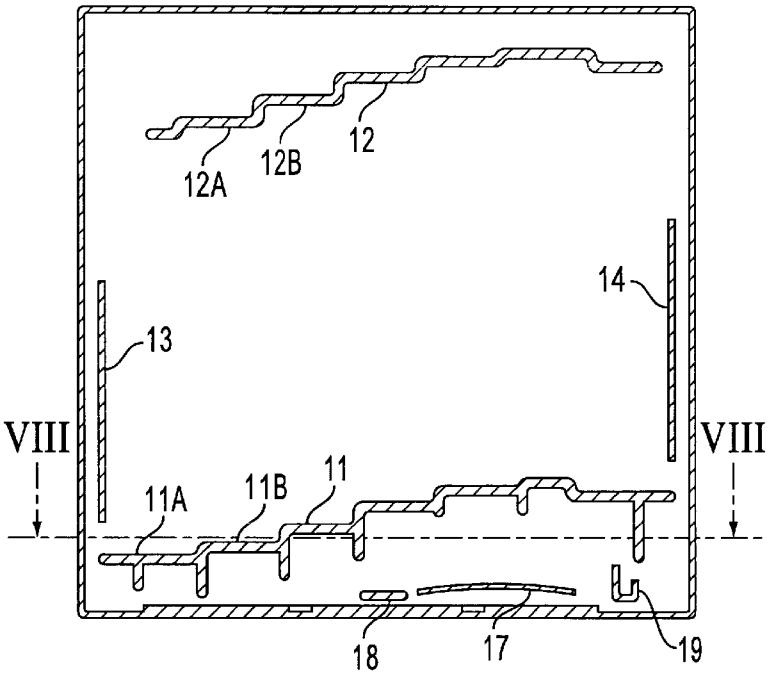
FIG. 6 is a sectional view of this front panel along section line VI—VI of FIG. 8.
Figure 8:
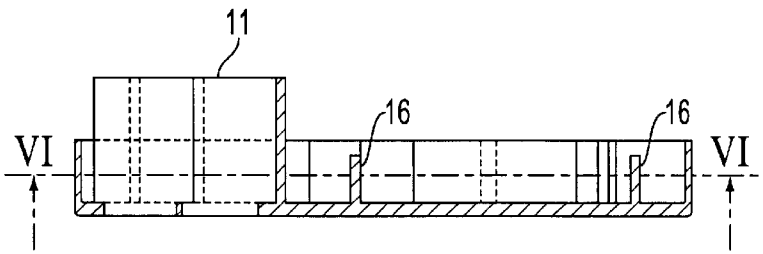
FIG. 8 is a transverse sectional view of this panel along line VIII—VIII of FIG. 6.

Similarly, for the precise positioning of guide elements intended to be positioned behind openings 8 to 9, the front panel 2 advantageously comprises, on its rear surface, lower ribs 17 and 18 and lateral ribs 19 visible in particular in FIG. 6.

These various positioning ribs are also visible, in dotted lines, in FIG. 5. It is noted in this regard that one of the stiffening ribs 16 of the lower rib 11 contributes, together with the rib 17, to the lateral positioning of the guide elements corresponding to the openings 8 and 9.

Figure 12:
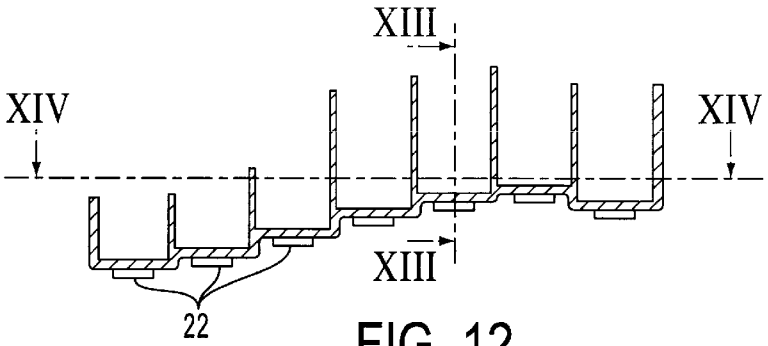
FIG. 12 is a sectional view of the set of housing elements of the device of FIG. 1 along section line XII—XII of FIG. 14.
Figure 13:
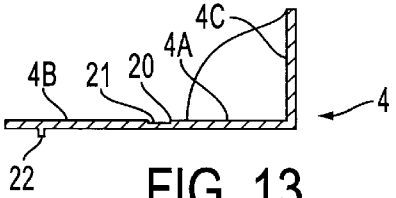
FIG. 13 is a longitudinal sectional view of this housing element along section line XIII—XIII of FIG. 12.
Figure 14:
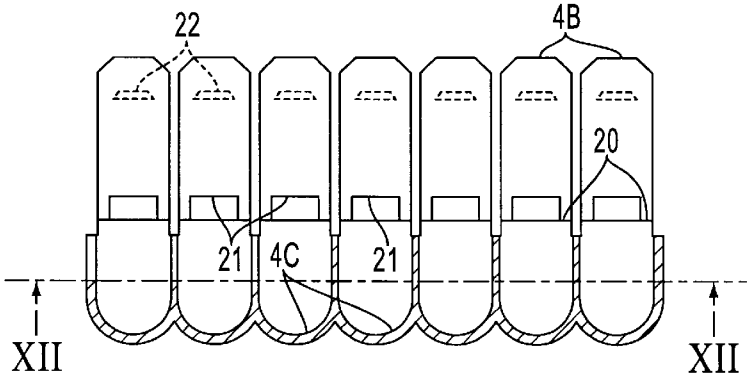
FIG. 14 is a sectional view of this housing element along section line XIV—XIV of FIG. 12.

FIGS. 12 to 14 show the housing elements 4 appearing in FIGS. 1 to 4.

In the example under consideration, the housing elements 4 are firmly attached to each other and thus form a single piece. They can, in a variant not shown, be independent from each other.

Each housing element 4 comprises a base portion 4A extended by a rear tab 4B and a lateral portion 4C defining with the base portion 4A a sort of balcony shaped so as to keep and secure the base of the product located there.

The base portion 4A is here slightly thicker than the rear tab 4B. There thus appears a step marked by the reference 20. This step is intended, when the retaining element 4 is introduced, to move into the plane of the front surface of the front panel.

Preferably, the lateral part 4C does not extend to the point of contact with this front surface of the front panel, laterally on both sides of each opening: in fact, it can be seen in FIG. 13 that this lateral portion 4C which has a maximum height on the opposite side of the rear tab 4B, has on both sides of this frontal portion a height which decreases progressively to 0 near the shoulder 20. Consequently, there is no link between this lateral portion and the front surface of the front panel other than by the base section 4A. This confers a certain elasticity on the housing element. Such a configuration ensures a good retention of the products whilst allowing an easy reintroduction.

Immediately behind the step 20, there is a cavity 21 the role of which will be apparent later.

Each rear tab 4B has a downwardly directed projection numbered 22. This projection 22 is intended to provide support, when the housing element passes through the rear tab into the inside of an opening, behind the rear section of the portion concerned of the lower rib 11.

The good positioning of each housing element is thus guaranteed by a clipping and wedging effect of this housing element in the opening by the arrival of a guide element above this rear tab.

Figure 3:
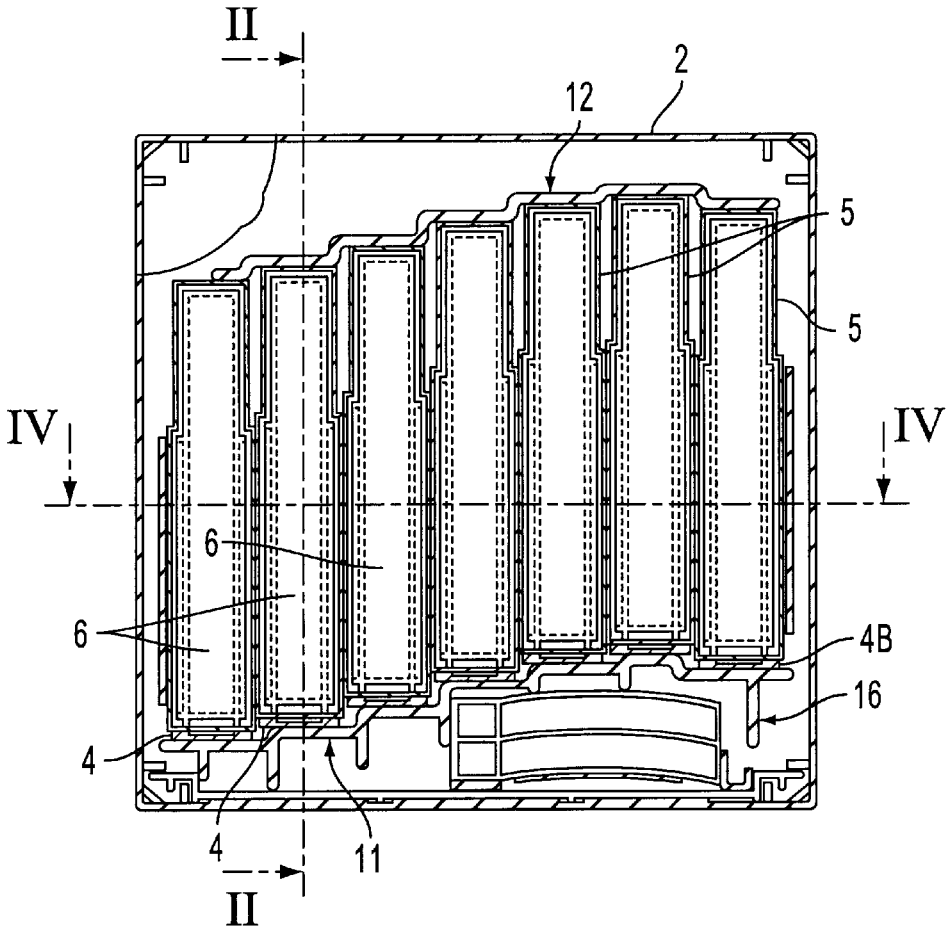
FIG. 3 is a sectional view of this device just behind the front surface of the latter along line III—III of FIG. 4.
Figure 4:
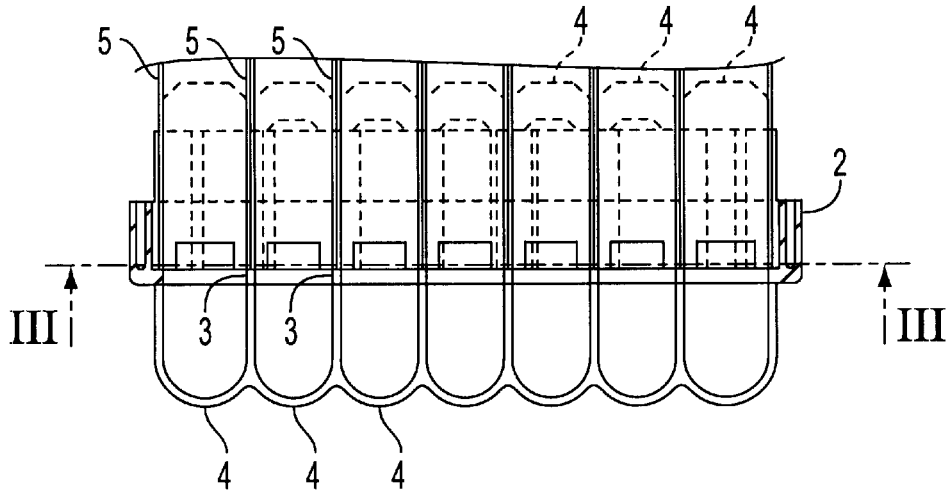
FIG. 4 is a transverse sectional view of the device along line IV—IV of FIG. 3.

It is noted in FIG. 3 that in fact the tabs 4B of the various housing elements are arranged between the lower rib 11 and the lower part of each guide element 5.

In fact, the housing elements can be fixed to the front panel and/or to the guide elements.

These housing elements can have in addition upper retention elements such as lateral grips or lugs, preferably flexible, for example integral with the housing elements.

Figure 15:
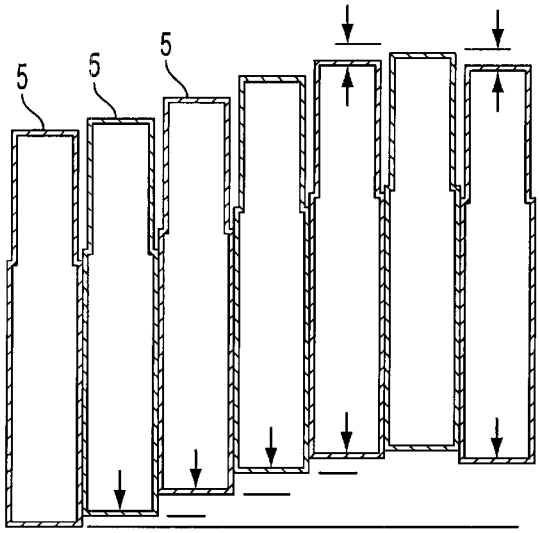
FIG. 15 is a sectional view of a set of guide elements fixed at the rear of the front panel.

FIG. 15 represents, by way of example, the set of guide elements intended to be connected to the front panel, made integral with each other. However, as already stated, they can, as a variant, be independent (although adjacent).

The general configuration of these guide elements adopts the vertical variation of openings 3 arranged in the front panel.

Moreover, these guide elements have, in the example shown, the same profile as these openings 3.

These guide elements thus have a shape corresponding to the superimposition of two narrow rectangles, the upper rectangle being slightly narrower than the lower rectangle.

As is apparent from FIG. 16, the width of the guide element is chosen so as to leave only a slight clearance e laterally on either side of the tube of mascara (for example of the order of one millimetre). In fact, taking into account the adopted shape of a double rectangle, each of the rectangles is here formed so as to run alongside, each one, the lower or upper part of the tube of mascara.

In a variant, which is not shown, the guide element can have a rectangular shape, having the height of the profile described in FIGS. 15 and 16 but having as a constant width that of the lower rectangle.

Moreover, the height of the profile is chosen so as to leave only a moderate vertical clearance e' between the top of the tube of mascara and the top of the guide element (for example of the order of 1 to 2 millimetres).

Thus, each guide element is formed so as to be able to guide the tubes of mascara from below, from above, and at the sides.

The guide elements 5 are here profiles which therefore have solid and continuous lower, upper and lateral surfaces. In a variant which is not shown, at least some of the areas of the guide element can be simple longitudinal support elements (or rails), in particular at the top part of the tube of mascara. This allows a saving on material.

Even when the guide elements have solid lateral and vertical walls, they can be formed of several pieces, that at the top having, for example, the desired elasticity desired for optional upper retention grips projecting forward of the front panel.

Figure 17:
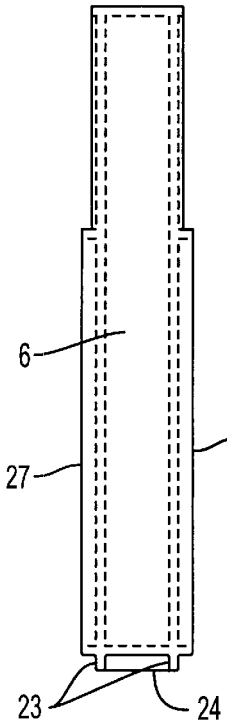
FIG. 17 is a front view of the pusher contained in one of the guide elements.
Figure 18:
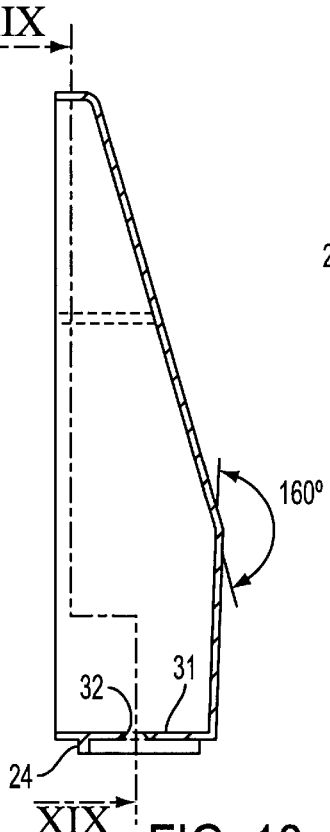
FIG. 18 is a longitudinal sectional view of this pusher along line XVIII—XVIII of FIG. 19.
Figure 19:
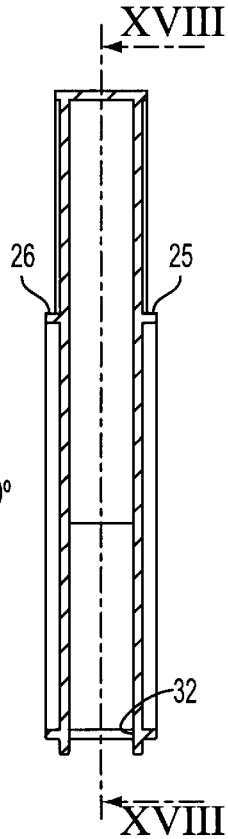
FIG. 19 is a transverse sectional view of this pusher along broken line XIX—XIX of FIG. 18.

FIGS. 17 to 19 show a pusher as shown under the reference 6 in FIGS. 1 and 2.

In the example under consideration, the pusher 6 has a shape more or less identical shape, with a clearance allowing a sliding, to the internal section of the guide element. In this way, the guide element is thus suitable to guide the pusher in the same manner as the tubes of mascara, i.e. from below, from above and laterally. In order to reduce the risks of blockage, the pusher advantageously comprises, in its base part, two longitudinal ribs 23 which are joined to a transversal rear rib 24. These ribs have the advantage that they minimize the contact surface between the pusher and the lower surface of the guide element and thus the sliding surface. Similarly, the sides of the pusher have lateral ribs 25, 26, 27 and 28 minimizing the surface in contact (clearances apart) with the guide element.

As is apparent from FIG. 18, the pusher has a front surface which comprises, over one part of its height, an more or less vertical section then, above this, a section inclined backwards and upwards. The advantage of this configuration appears clearly in FIG. 2 where it is seen that the last tube of mascara in a column can, taking into account the general shape of this tube and of those which precede it, rounded in a central portion but thin in the base portion, lean backwards. In this way, the force exerted by the pusher on the last tube of mascara is gradually transmitted to the first tube of mascara whilst still permitting the latter to adopt a vertical configuration rather than a forward leaning configuration. Thus, the tube of mascara or first two tubes of mascara of each column which are visible are displayed in a tidy vertical form rather than in a forward- or sideways-leaning configuration.

In practice, the geometry of the front surface of the pusher depends on the geometry of the tubes of mascara. It is thus that for example, if this tube has, in place of the rounded configuration of FIG. 16, a concave configuration, between the neck section on which the cap is attached and a lower base, the lower potion of this front surface can be inclined rearwards and downwards so as to present, in a view similar to that of FIG. 18, a protuberance towards the right suitable to be in contact with the body of a tube of mascara in its concave zone.

As appears in FIG. 2, and as has already been indicated, the device for displaying and dispensing tubes of mascara comprises an elastic element numbered 7.

As is apparent from FIG. 2, this elastic element rests on the pusher marked 6 and extends from this under the base of the tubes of mascara to an attachment zone, numbered 30 in FIG. 2. In a variant which is not shown, this element can extend above the tubes.

It can be noted that this elastic element is here a strip made from elastic material, for example spring steel, which extends into the actual inside of the guide element 5. It is fixed to the base part of this guide element by any appropriate known manner in a zone sufficiently advanced towards the housing element to ensure a thrust sufficient for applying a maintaining force on the tube of mascara 1 which is located in the housing element.

More precisely, in the example shown, the elastic element 7 is fixed at its front part more or less in the plane of the front panel 2, here thanks to a notch which is not shown arranged in the lower wall of the guide element 5, more or less opposite the notch 21 visible in FIG. 14.

This elastic element 7 can, in a particularly simple variant of the pusher, rest directly on the rear surface of the lower (indeed upper) portion of the front wall of the pusher.

However, as is apparent from FIGS. 2 and 18, the pusher, in particular for reasons of rigidity, advantageously comprises a base zone marked 31 in which is arranged a notch 32 the edges of which are advantageously inclined downwards so as to be easily crossed by the elastic element without generating friction and without the risk of wear during the sliding of this elastic element through this notch 32.

The elastic element 7 can be split into several springs as will be apparent later with reference to FIG. 39.

FIGS. 20 to 36 together show a variant embodiment of the displaying and dispensing device of FIGS. 1 to 19.

Figure 20:
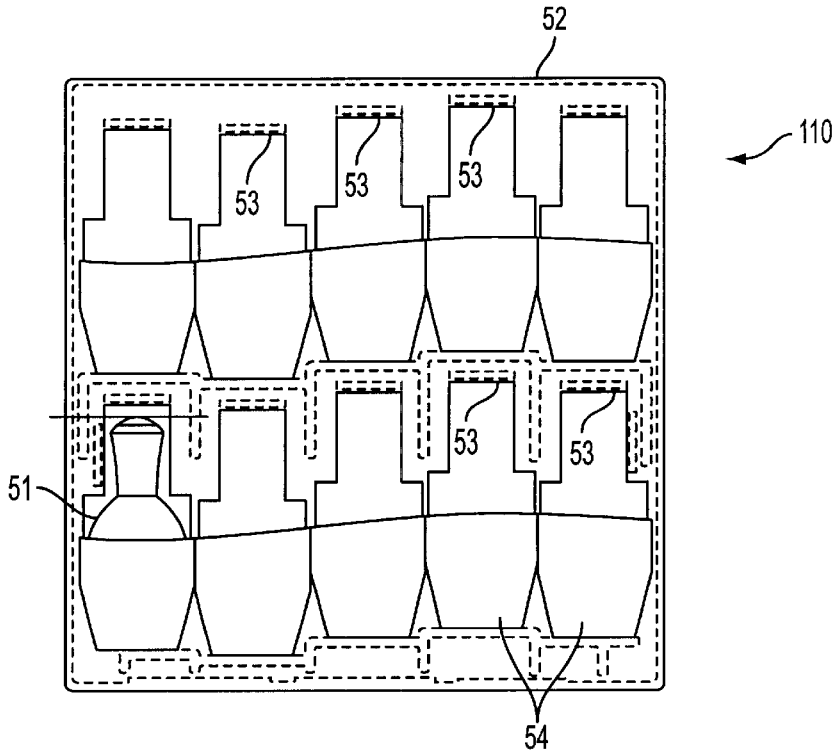
FIG. 20 is a front view of another device for displaying and dispensing products corresponding to the case of bottles of nail varnish.

More precisely, the displaying and dispensing device shown in FIG. 20 under the general reference 110 is intended for displaying and dispensing another type of cosmetic product, in this case bottles of nail varnish, an example of which is shown under the reference 51.

The design principle of this dispensing and displaying device 110 is similar to that of the device of FIGS. 1 to 19. For this reason, the elements of this device 110 correspond to those of the device 100 of FIGS. 1 to 19 with the addition of the number 50.

Figure 21:
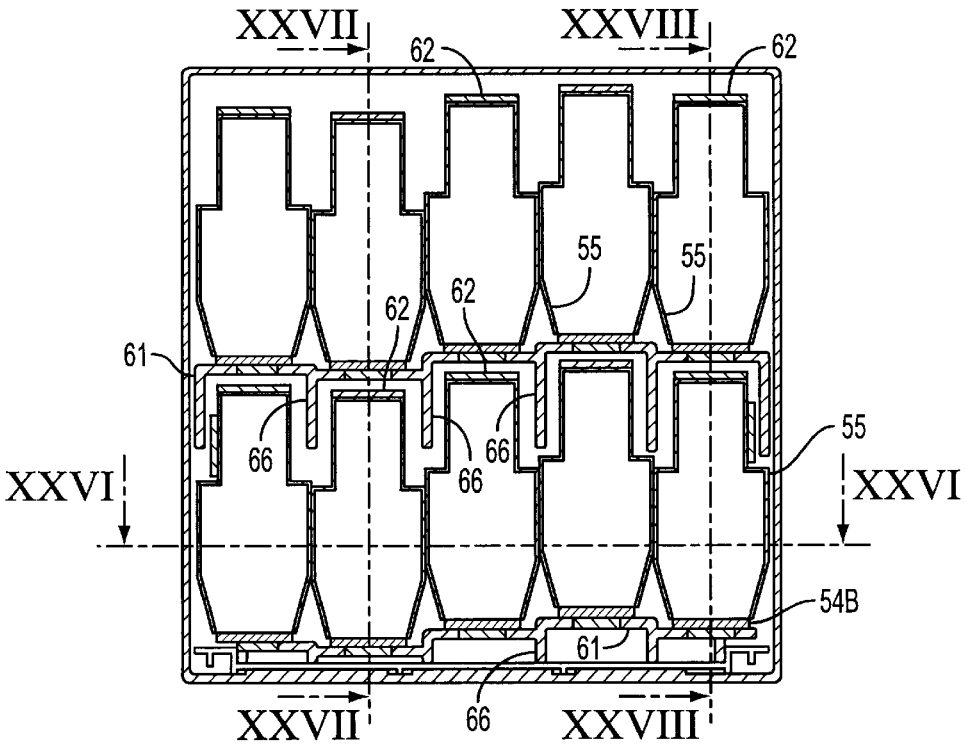
FIG. 21 is a sectional view of this assembly just behind the front surface of the front panel.

For this reason, the device 110, as it appears in FIG. 20, comprises a front panel 52 in which openings 53 are arranged, housing elements 54 opposite each of the openings 53 and, as is visible in FIG. 21, guide elements 55 behind each opening 53.

In fact, a bottle of nail varnish commonly has a height appreciably lower than that of a tube of mascara. For this reason, assuming it is decided in the hypothesis where it is fixed such that the front panel 52 has the same dimensions as the front panel 2 of the device 100, it is possible to provide vertically for two rows of bottles of nail varnish. It is therefore observed in FIG. 20 a set of ten openings 53 with thus, as is apparent from FIG. 21, a set of ten guide elements 55.

The front panel 52 comprises, as in the case of the panel 100, lower ribs marked 61.

Inasmuch as the openings 53 are at different levels, the lower ribs 61 have, as is the case for the rib 11, a set of steps each intended to be arranged below one of the openings.

Figure 30:
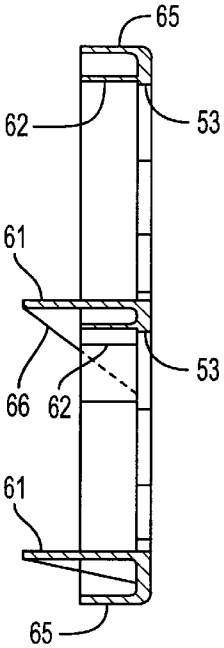
FIG. 30 is another sectional view of the front panel along line XXX—XXX of FIG. 22.
Figure 29:
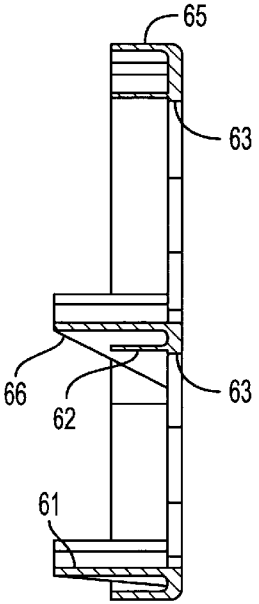
FIG. 29 is a sectional view of this front panel along line XXIX—XXIX of FIG. 22.

As previously, these lower ribs 61 preferably have, as is apparent from FIGS. 29 and 30, a dimension perpendicular to the plane of the front surface of the front panel which is approximately equal to twice that of said panel.

Similarly, these lower ribs 61 are provided, so as to ensure a good mechanical resistance, with stiffening brackets 66.

The front panel 52 also comprises, by analogy with that which was indicated as regards the device 100, upper ribs 62. The presence of the stiffening brackets 66 visible as regards the lower rib of the upper row of the opening in FIG. 21, requires the upper rib 62 of the lower row of openings to be discontinuous. The same discontinuous configuration appears as regards the upper row of openings. It must however be understood that, by way of a variant, the upper rib 62 of the upper row of openings can be continuous such as the rib 12 of the device 100.

By analogy with that indicated with reference to the device 100, the housing elements 54 comprise rear tabs 54B interposed between the lower rib and the base wall of the guide element in question.

Figure 24:
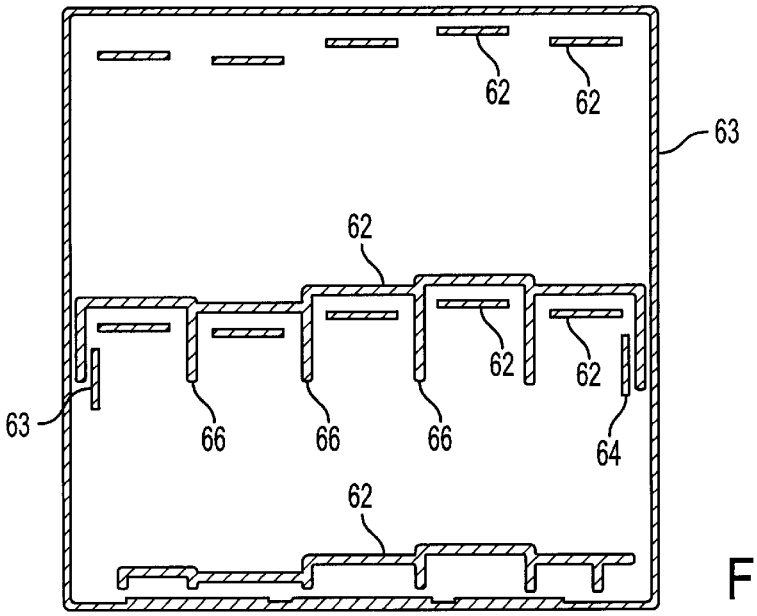
FIG. 24 is a sectional view of the front panel along line XXIV—XXIV of FIG. 23.
Figure 26:
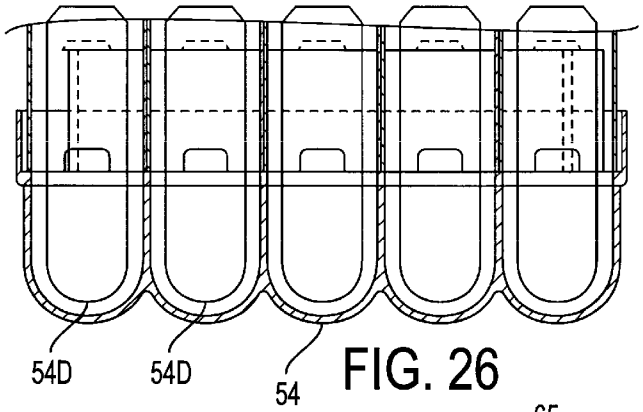
FIG. 26 is a sectional view along line XXVI—XXVI of FIG. 21.

As is clearly apparent from FIG. 24, lateral positioning ribs 63 and 64 are provided, but solely for the lower row of openings. Of course, in a variant which is not shown, such lateral positioning ribs can also be provided for the upper row of openings.

The guide panel 52 is bordered over all of its circumference by an edge 65.

Figure 22:
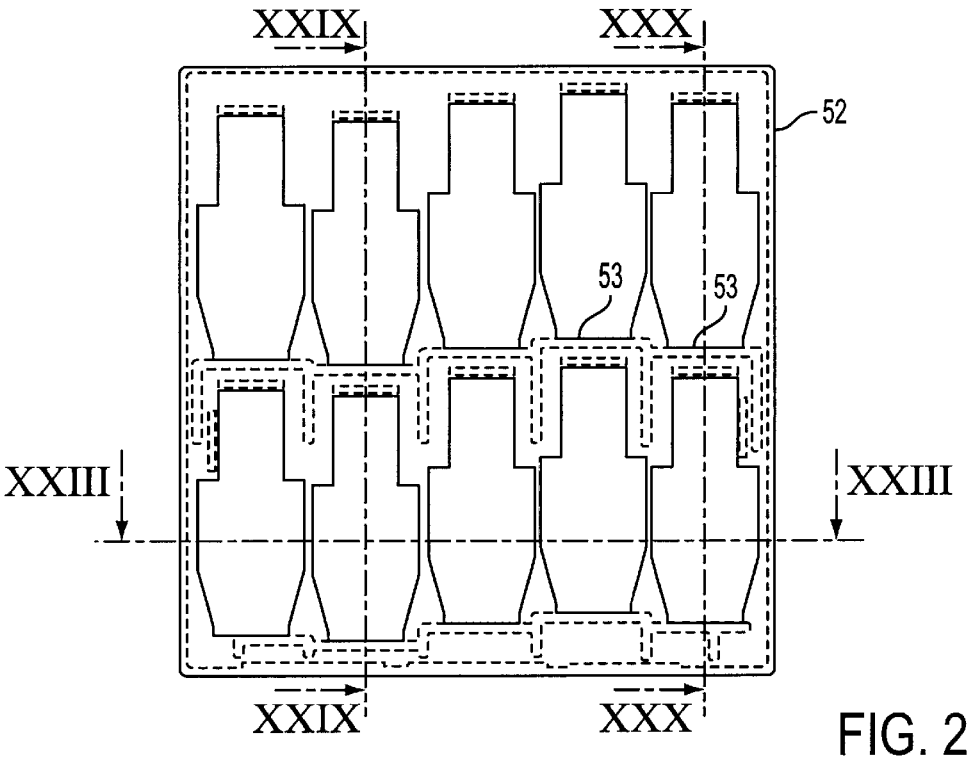
FIG. 22 is a front view of the front panel of the displaying and dispensing device of FIG. 21.
Figure 23:
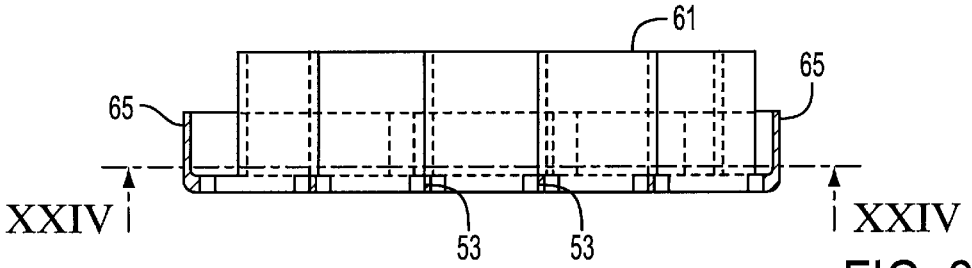
FIG. 23 is a sectional view of the front panel along line XXIII—XXIII of FIG. 22.
Figure 25:
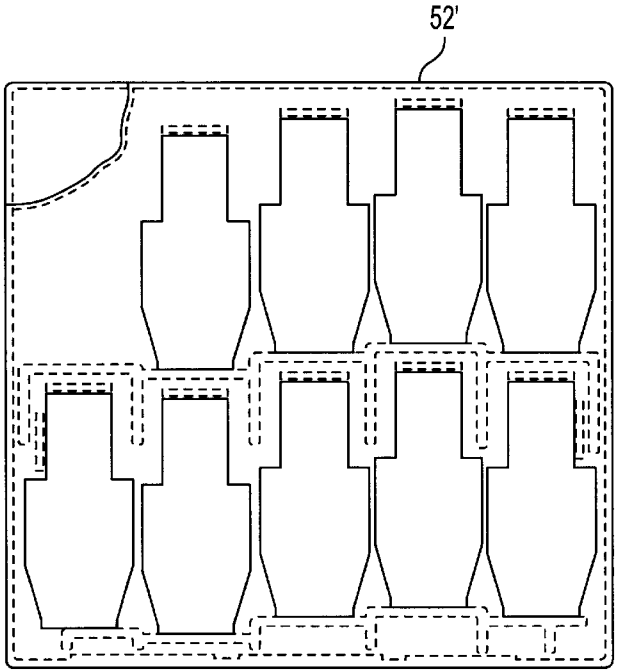
FIG. 25 is a view of a front panel of another device for displaying and dispensing bottles of nail varnish corresponding to a variant embodiment of the front panel of the device of FIG. 20.
Figure 31:
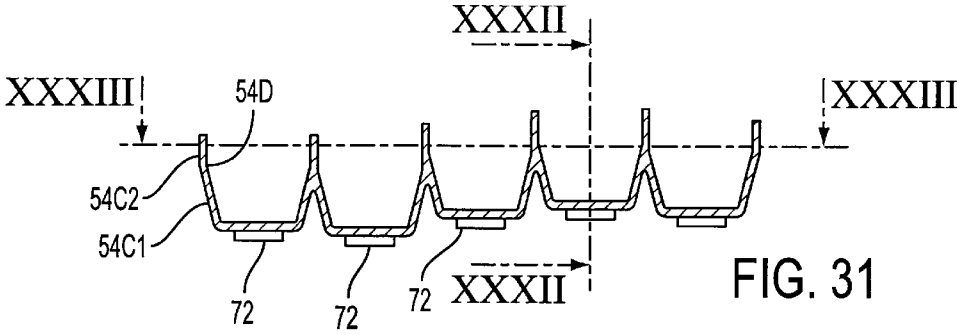
FIG. 31 is a sectional view of the set of housing elements along line XXXI—XXXI of FIG. 33.
Figure 32:
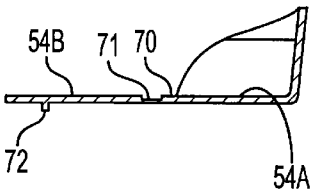
FIG. 32 is a sectional view of a housing element along line XXXII—XXXII of FIG. 31.
Figure 33:
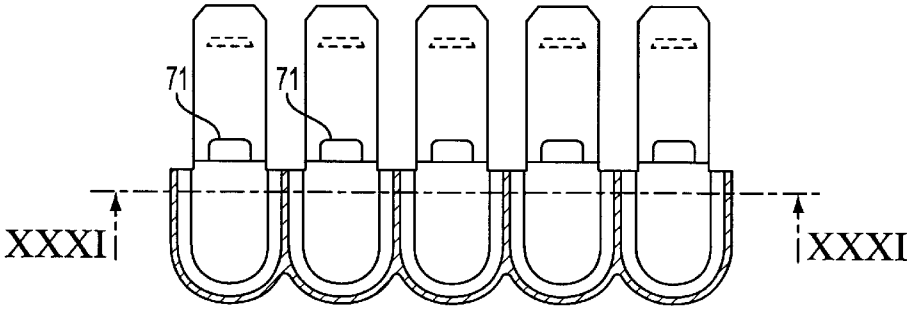
FIG. 33 is a sectional view of this set of housing elements along line XXXIII—XXXIII of FIG. 31.

FIG. 25 shows under the reference 52' a variant embodiment of the front panel of the FIG. 22 with, as the only difference, a number of openings reduced to four in the upper part. In fact, there is complete flexibility as regards choice, in the lower and upper parts, of the numbers of different openings.

Taking into account the shape of a bottle of nail varnish as shown in part in FIG. 20, which has a very bulging shape at more or less half-height whilst its base is very much narrower than this bulging part, the housing element 54 playing the role of a balcony comprises, from the base portion 54A, a slightly divergent bottom lateral portion 54C1 then a top lateral section 54C2 which is more or less vertical. An interruption to the slope marked 54D is thus observed in FIGS. 31 and 33.

Figure 28:
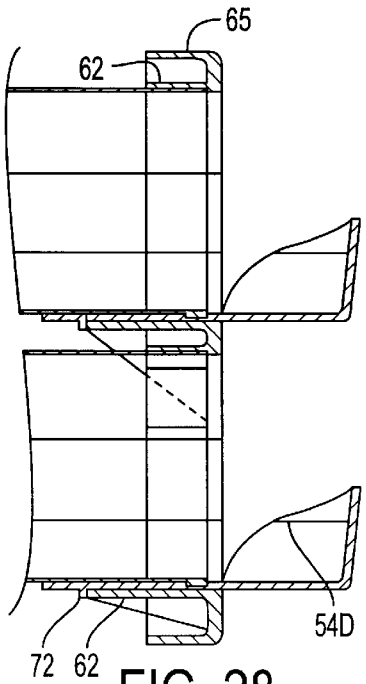
FIG. 28 is a sectional view of the same assembly along line XXVIII—XXVIII of FIG. 21.
Figure 27:
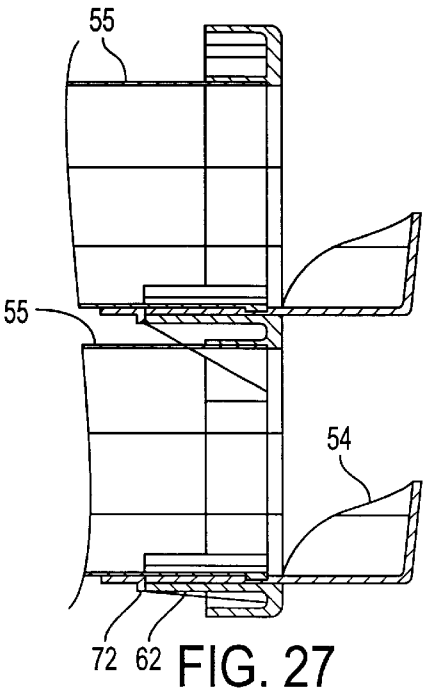
FIG. 27 is a partial sectional view of this assembly along line XXVII—XXVII of FIG. 21.

The housing elements 54 comprise, also by analogy with that indicated as regards device 100, a step 70 between the base portion 54A and the rear tab 54B, a slight depression 71 directly behind this step and a downwards projection 72 intended as is apparent in particular from FIGS. 27 to 28, to arrive directly behind the corresponding lower support rib 62.

Figure 34:
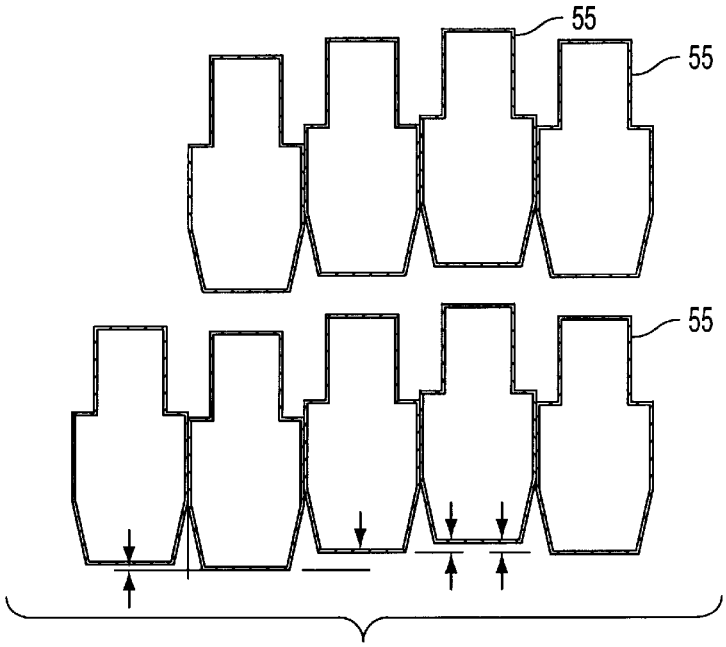
FIG. 34 is a sectional view of the set of guide elements of a device for displaying and dispensing bottles of nail varnish, in accordance with the device of FIG. 20 but in the case of the variant of FIG. 25.

FIG. 34 represents a set of two rows of guide elements 55 attached laterally to each other. There are therefore two sets of guide elements, the lower set comprising five guide elements whilst the upper set comprises only four guide elements. This set of guide elements formed from two lower and upper parts is thus suitable for fixing to the rear of the front panel 52' of FIG. 25. By way of a variant these guide elements can be individually independent, although adjacent.

Figure 35:
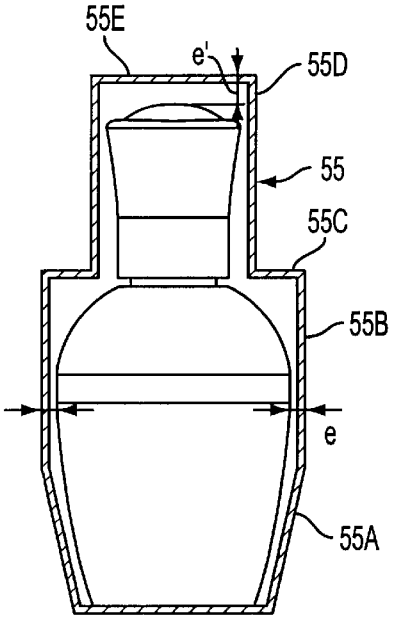
FIG. 35 is a sectional view of a guide element containing a bottle of nail varnish.

As is apparent from FIG. 35, a guide element 55 has a geometric shape which is simpler than that of the shape of the bottle of nail varnish whilst similar, clearances apart, to this shape of the bottles. Thus the guide element 55 of FIG. 35 comprises a first portion 55A inclined upwards and outwards, a more or less vertical portion 55B, a step 55C and a vertical portion 55D. The portion 55B is positioned so as to run with a slight clearance e alongside the bulging portion of the body of the bottle of nail varnish whilst the vertical portion 55D is positioned so as to run with a similar slight clearance alongside the cap of this bottle of nail varnish.

Similarly, the upper wall 55E of the guide element 55 is similar, clearance e' apart, to the upper part of the cap of the bottle of nail varnish.

Thus, upon its displacement along this guide element, the bottle of nail varnish is held from below by the lower wall of the guide element, laterally to the right and the left by the parts 55B and 55D and from above thanks to the section 55E. Of course, an even simpler shape can be chosen for the guide element 55. Thus, for example, it can be envisaged that the guide element has, as was indicated as regards the tubes of mascara, the shape of a superimposition of two rectangles, or even the shape of a single rectangle.

In practice, it appears desirable, in order to best hide what is situated behind the front panel, for each opening 53 to have a shape which best approximates that of the product in question, namely a bottle of nail varnish. And, it appears desirable but not necessary for the guide element to have a similar shape to that of the opening. But it is understood that even simpler shapes may need to be chosen.

As already indicated as regards the guide element 5, the guide element 55 is advantageously constituted by a section extending continuously along the guide path of the products to be guided. This section can be constructed in several pieces.

Of course, other shapes are possible, for example lower, upper and lateral bars suitable for ensuring the vertical and lateral support of each product. The vertical guidance is not necessary along the upper part of the body to be guided; thus an efficient guiding can be carried out by means of a lower surface along which the foot of the bottles moves, two lateral bars laterally supporting the bodies and two slightly closer bars preventing the bottle from rising up while being guided where it narrows at the base of the cap.

Similarly, it is not necessary for the pusher to have the same shape as the section of the guide element. Thus, in FIG. 36, the pusher 56 has a front surface, more or less vertical, which extends only over the section of the bulging lower part of the guide element, being sufficiently broadened in the upper portion to enable it to be guided, during sliding, from below, laterally and from above thanks to the horizontal portions 55C.

FIGS. 37 to 42 show a variant embodiment of the device in FIGS. 1 to 19. More or less the same elements are found there, designated under reference numbers deriving from those in FIGS. 1 to 19 with the addition of the "prime" symbol.

It is observed that the guide elements 5' are separate. Their height varies with a decrease, an increase then a new decrease. Similarly, the housing elements 4' are separate although adjacent.

Moreover, both the lower rib 11' and the tabs of the guide elements have openings 21' and 11'A together forming a fixing zone 30' for the front end 7'A of an elastic element 7'.

Each pusher 6' is in fact here forced elastically forwards by two springs: the lower spring 7' mentioned previously and an upper spring 7", running alongside and above the products and hooked to the front panel at its end 7"A thanks to openings arranged at 30" through the upper rib 12'. The front ends 7'A and 7"A of the two springs advantageously project beyond the top and base walls of the guide elements thanks to depressions 2'A arranged in the front panel.

Figure 42:
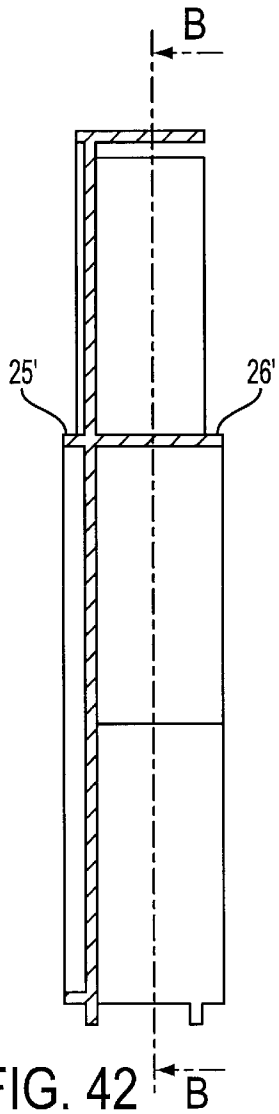
FIG. 42 is a transverse sectional view along line A—A of FIG. 40.
Figure 41:
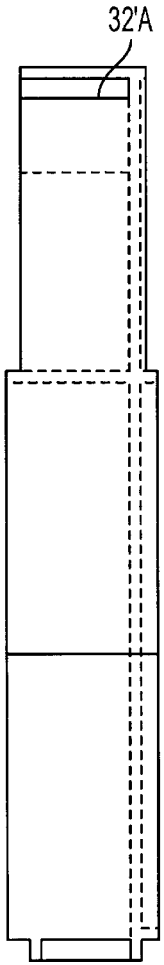
FIG. 41 is a front view of this.
Figure 40:
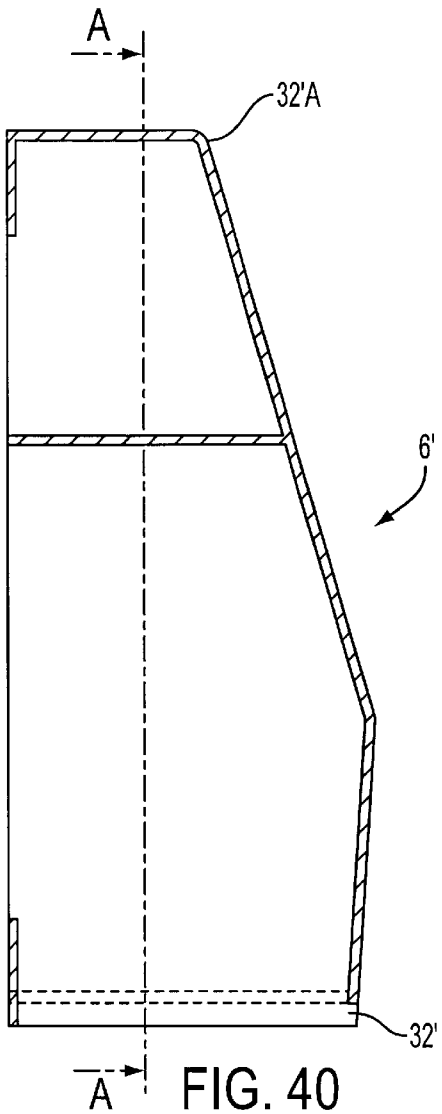
FIG. 40 is an elevation view in longitudinal sectional view along line B—B of FIG. 42 of the pusher of the device of FIGS. 37–39.

The pusher 6' of FIGS. 40 to 42 is distinguished from that of FIGS. 17 to 19 mainly by the fact that it comprises only a longitudinal wall (that on the left if FIGS. 19 and 42 are compared) which contributes to lightening this pusher (on the other hand, a horizontal strut links the median ribs 25' and 26') and by the fact that its front wall has a lower slit 32' for the passage of the lower spring 7' and an upper slit 32'A for the passage of the upper spring 7".

The horizontal strut linking ribs 25' and 26' defines within the pusher an upper compartment capable of housing the spiral of the upper elastic element.

The presence of the two springs allows the return force to be adjusted as required; by way of example, when the front 2' is orientated upwards and when the set of two springs ensures a return strong enough to counteract gravity but gentle enough to not to eject the product or to cause banging, there is the option to unhook the upper spring when changing the arrangement of the device so that the front panel is vertical.

Figure 45:
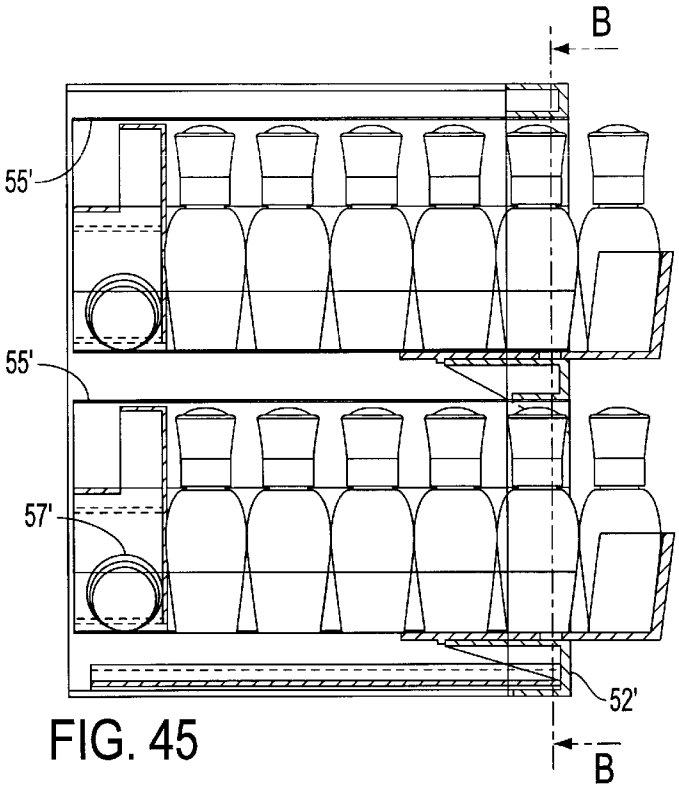
FIG. 45 is a longitudinal sectional view along line A—A of FIG. 43.
Figure 44:
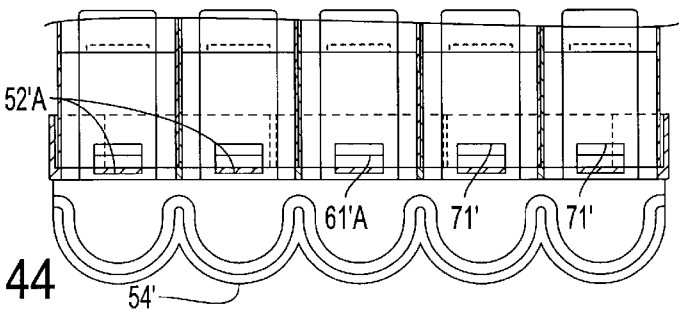
FIG. 44 is a partial sectional view along line C—C of FIG. 43.
Figure 43:
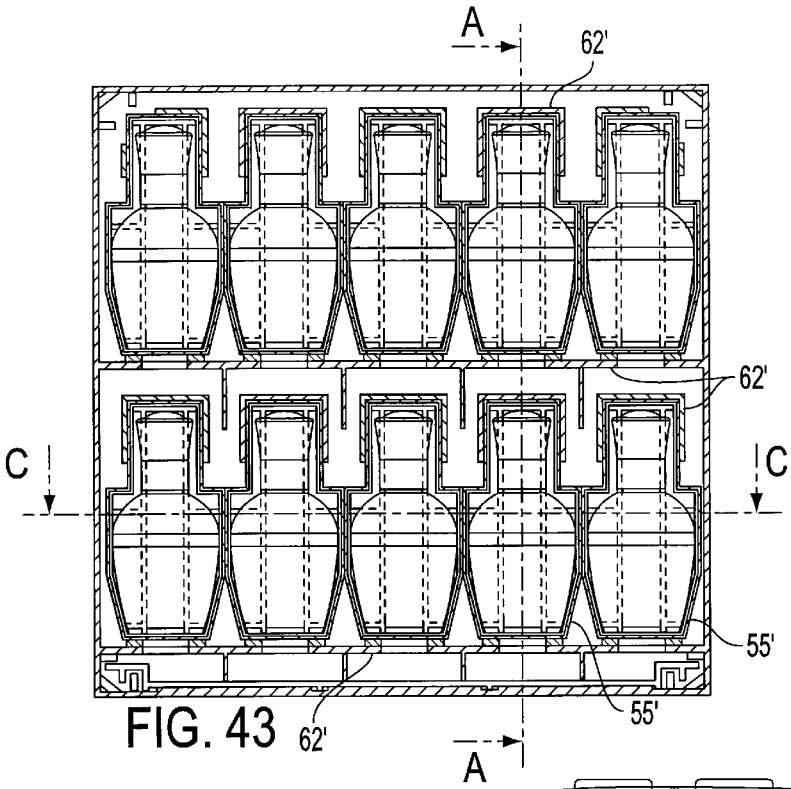
FIG. 43 is a sectional view along line B—B of FIG. 45 of a variant embodiment of the device for displaying and dispensing bottles of nail varnish.
Figure 48:
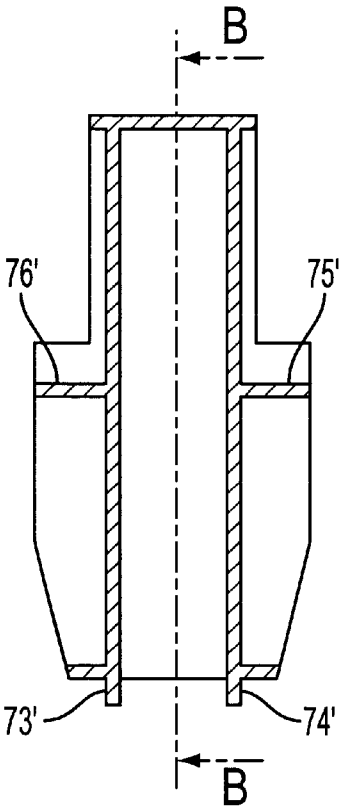
FIG. 48 is a transverse sectional view along line A—A of FIG. 46.
Figure 47:
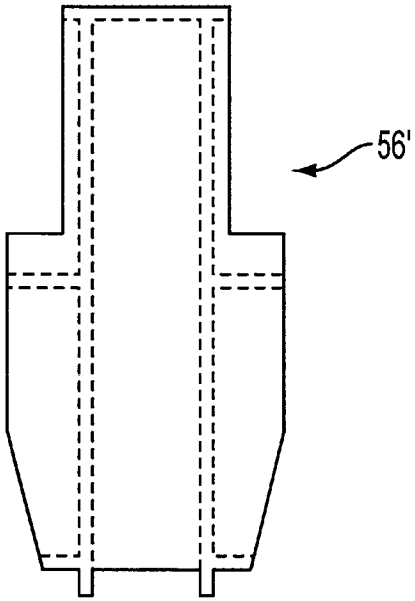
FIG. 47 is a front view of this.
Figure 46:
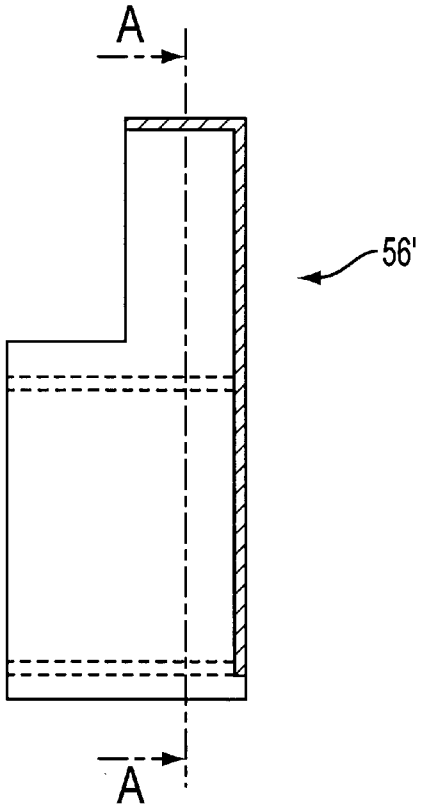
FIG. 46 is a longitudinal sectional view along line B—B of FIG. 48 of the pusher of FIGS. 43 to 45.

As regards FIGS. 43 to 45, they show a variant embodiment of the device in FIGS. 20 to 36. More or less the same elements are fond there designated under reference numbers deriving from those in FIGS. 20 to 36 with the addition of the "prime" symbol.

It is observed that all the products in the same row are at the same height; this also applies for the lower and upper ribs 62'.

The guide elements 55', although adjacent, are independent.

Figure 39:
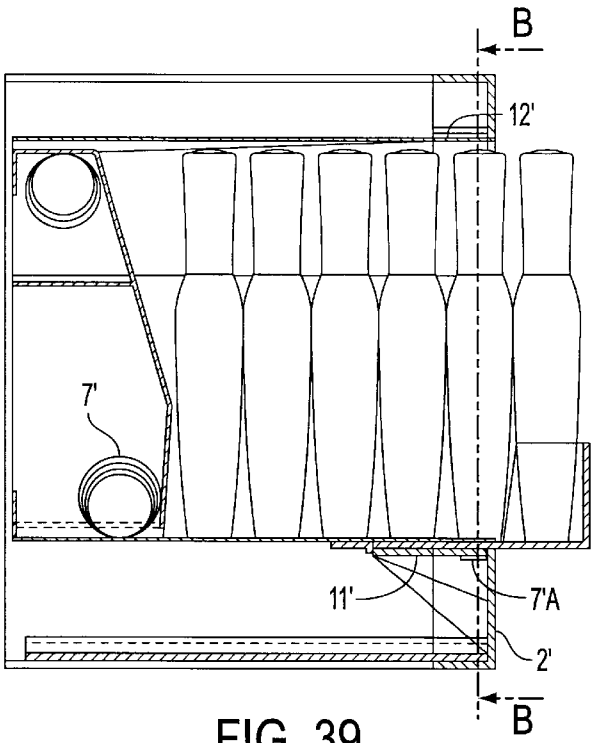
FIG. 39 is a longitudinal sectional view along line A—A of FIG. 37.

There is only a lower spring, called 57', the front end of which, by analogy with the end of the spring 7' of FIG. 39, passes in front of the lower wall of the guide element thanks to a depression 52'A of the front panel, then through openings 71' and 61'A arranged through the tabs of the housing elements and lower ribs 62'.

Figure 36:
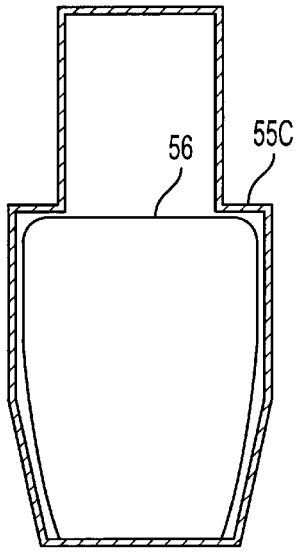
FIG. 36 is a sectional view of this guide element in which the associated pusher is shown.

As for the pusher 56', it is essentially distinguished from that of FIG. 36 by the fact that it extends to the top of the section of the corresponding guide element.

By analogy with the pusher 6 of FIGS. 17 to 19, it comprises two lateral walls provided with lower ribs 73' and 74', bordered by low lateral ribs and median lateral ribs 75' and 76'. There is a space 72' between the base of the front wall and the base of ribs 73' and 74', intended for the passage of the elastic element 57'.

Figure 49:
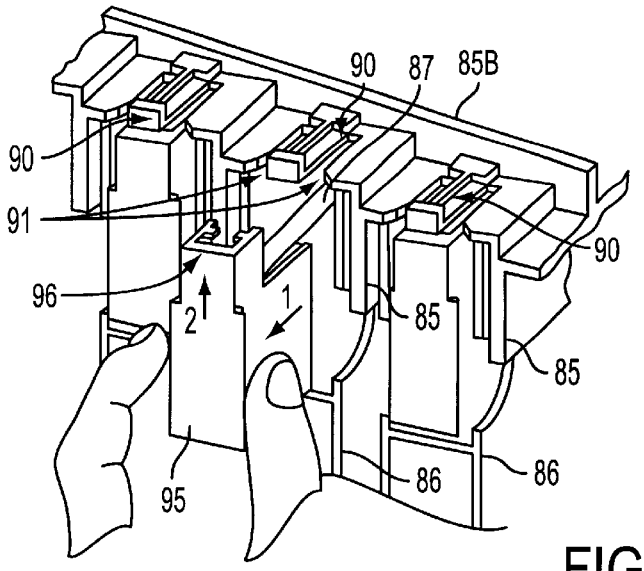
FIGS. 49 to 51 are rear perspective views of a group of guide elements the pushers of which are disconnectable.
Figure 50:
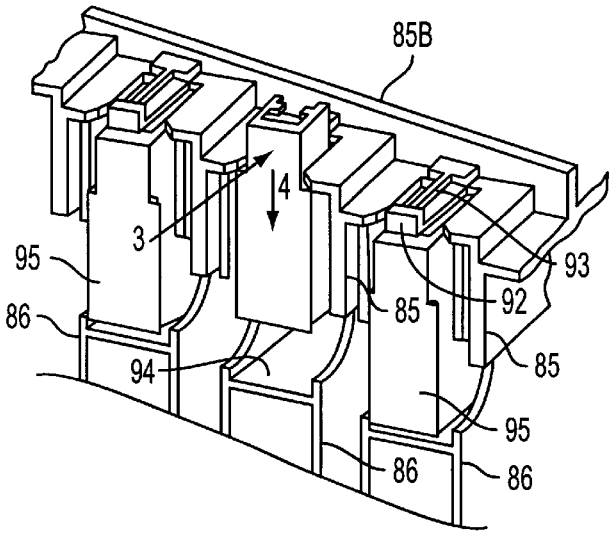
Figure 51:
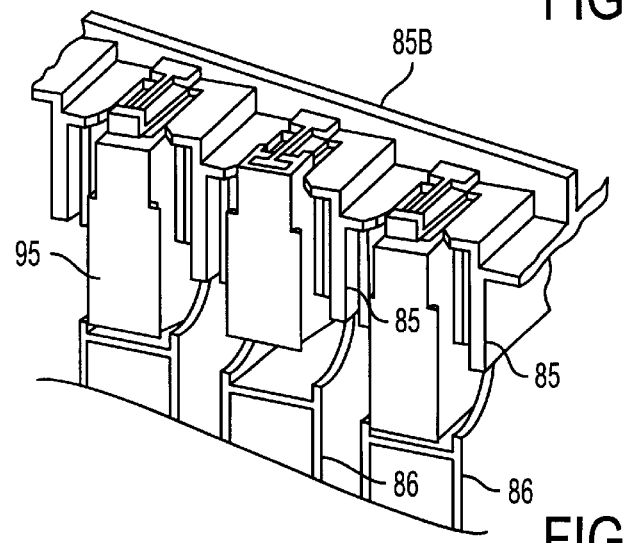

FIGS. 49 to 51 show a particularly useful variant, original in itself, for mounting a spring in a pusher engaged in a guide element.

These figures show the rear top part of a group of three guide elements 85 held by a strut 85B and in which pushers 86 are engaged. These contain an elastic element at the bottom. By way of a variant, not shown, what will be described, can be mounted in the bottom rear part of pushers and guide elements.

A particular feature of the upper part of each guide element compared with the above in that it comprises a projection 90 towards the rear, here bordered by two slits 91. In preferred manner, this projection 91 itself has an upwardly-directed slit 92, advantageously stiffened by a rib 93.

As regards the pusher, it comprises a compartment 94 open to the rear in which a block 95 is engaged with clearance, to which the back end of an elastic return element 87 is connected. This block 95 comprises in its top part an upward-and-forward pointing extension 96, the configuration of which is chosen so to be capable of co-operating with the projection 90 of the guide element 85; thus the portion of this extension which points forwards comprises a T-shaped slit.

The block 95 is normally engaged in the compartment and transmits to a front wall of this compartment and therefore to the pusher, the force exerted by the elastic element.

When it is desired to neutralize the action of this elastic element, it is sufficient to impart to the block 95 backward, upward, forward and downward movements indicated by the arrows 1 to 4 in the figures. The block is thus at least temporarily detached from the pusher. Any reactivation of the elastic element is very easy as it is sufficient to reverse the four movements mentioned previously.

Figure 52:
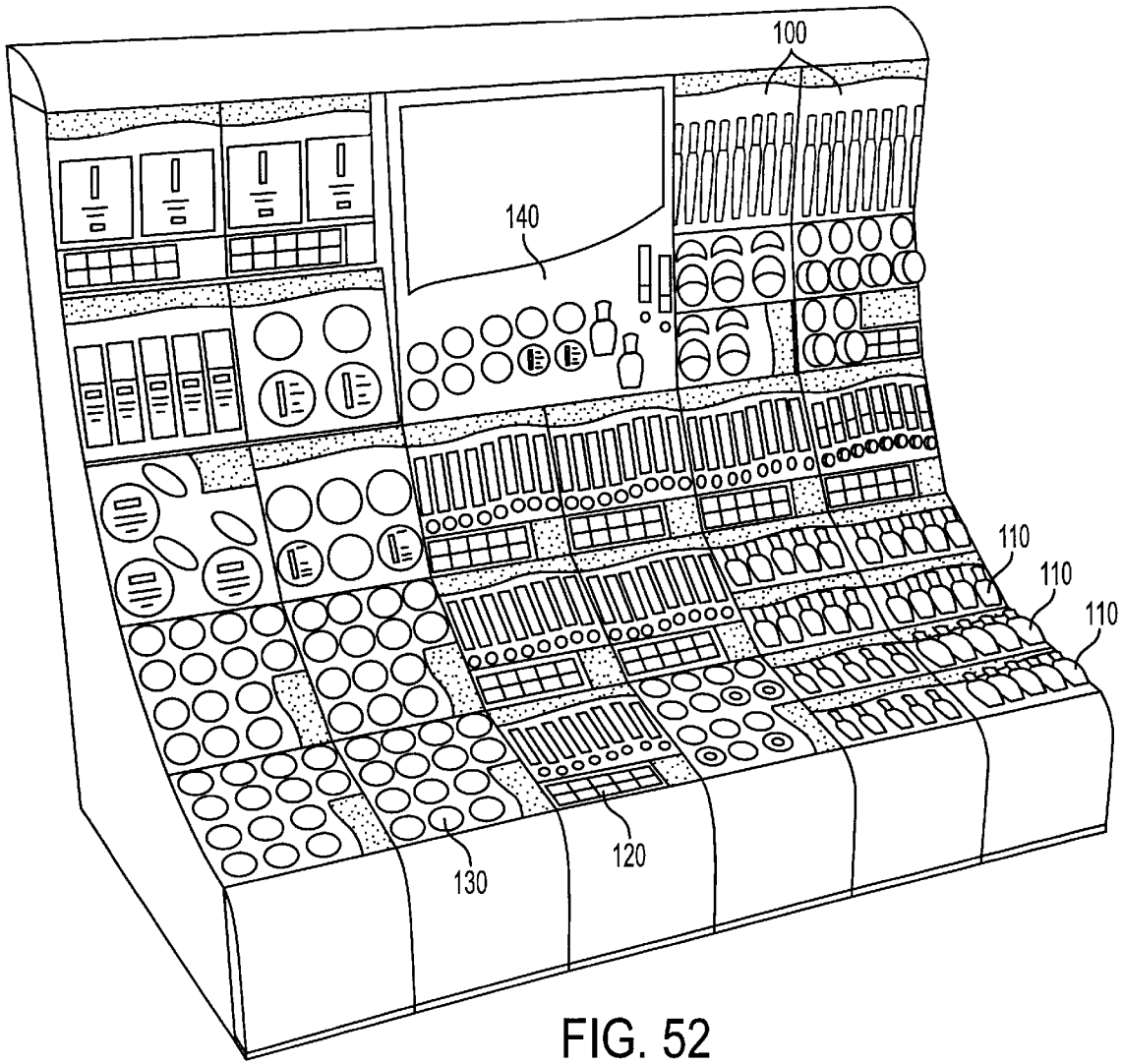
FIG. 52 is an overall view of a display unit formed from a plurality of displaying and dispensing devices similar to those of the preceding figures.
Figure 53:
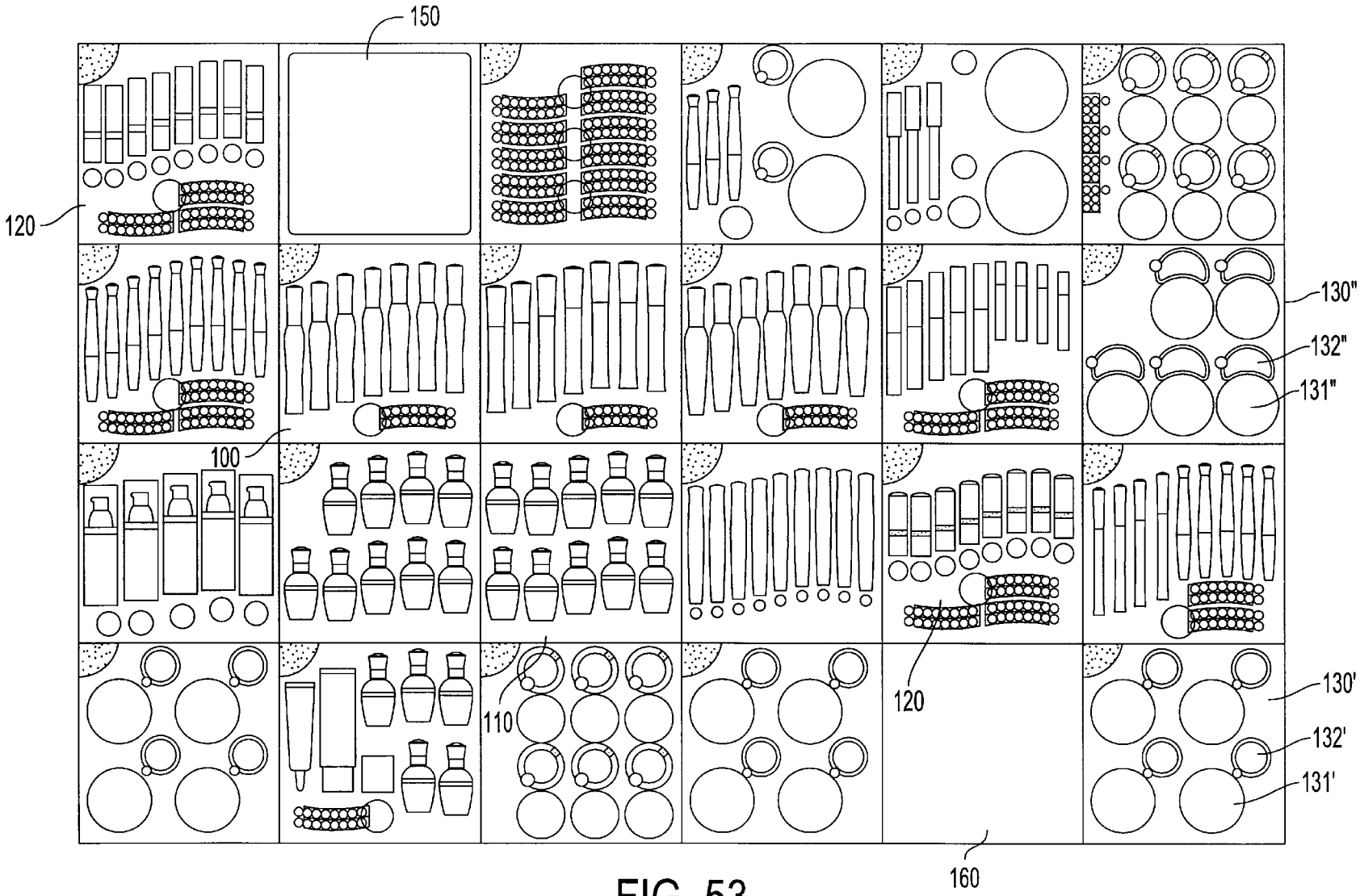
FIG. 53 is a flat view of an example of a configuration of different devices intended for the display and dispensing of different cosmetic products.

FIGS. 52 and 53 show examples of combinations of devices which can be realized in accordance with the invention.

The combination of devices is left to the imagination of the person who assembles the display unit.

Thus, the fact that all the devices have a front panel with the same dimensions is of advantage. Thus, modular blocks are available.

The display unit in FIG. 52 has an inwardly-curved shape, i.e. the lower blocks have almost horizontal front panels whilst the upper blocks are almost vertical; the intermediate blocks have intermediate gradients. This overall display is entirely up to the choice of the person responsible, who may by way of a variant prefer to feature more marked changes in gradient.

The elastic element (comprising one or more springs) linked to a given device has elastic capacities preferably adapted to the service configuration: the spring will be stronger in a horizontal configuration than in a vertical configuration in order to be able to compensate for gravity.

The principles stated above as regards tubes of, mascara 100 or bottles of nail varnish 110 can be easily extended to any other cosmetic or parapharmaceutical product; thus sticks of lipstick can be displayed and dispensed by a device as shown under the reference 120; and compacts of make-up or foundation can be displayed or dispensed by devices such as that shown under the reference 130.

Certain blocks can be of different dimensions and serve for displaying and dispensing different products, as is shown under the reference 140, with a block which simultaneously offers compacts, bottles and sticks of lipstick.

One configuration example is shown in more detail in FIG. 53 which clearly shows that the implementation of the invention leaves ample scope for account to be taken of the aesthetic aspect by combining openings for displaying and dispensing testers or simple decorations.

Thus the block 130' has four locations for products 131' and four locations for tester products 132' according to a configuration of staggered rows. The block 130" has five locations for products 131" each surmounted by a location for tester products 132".

It is possible that not all of the blocks are contiguous. Thus, spaces can be vacant. By way of example, a vacant space can be hidden by a front panel 150 without an opening or by a simple screen 160.

It will be appreciated that each device needs very little maintenance (the replacement of the products in the housing element is automatic) and derives optimum benefit from the available space, as stocking is carried out in situ (behind the front panels) whilst allowing, thanks to these front panels, a highlighting of products through the desired aesthetically pleasing presentation.

It is self-evident that the above description has been proposed purely by way of non-limitative example. Thus for example, other types of elastic elements are possible and these can be subjected to both tensile (case shown in FIG. 2) and compressive stress.

What is claimed is:

1. Device for displaying and dispensing a plurality of products of the same format, in particular in the field of cosmetics or parapharmaceuticals, comprising:

a front panel (2, 52, 52') pierced by at least one opening (3, 53) shaped so as to be able to be crossed by a product (1, 51)

a housing element (4, 4', 54, 54') connected to the front panel in front of each opening and shaped so as to be able to house and hold the lower part of a product;

a guide element (5, 5', 55, 55') lying perpendicular to the front panel and connected to the front panel behind each opening and shaped so as to hold, with clearance, the products from below, from above and on the sides;

a pusher (6, 6', 56, 56") engaged with clearance in the guide element and shaped so as to be able to be held by this element from below, from above and on the sides;

an elastic means (7, 7', 57') forcing the pusher towards the opening.

2. Device according to claim 1, characterized in that the housing element comprises a lateral wall made from a more or less transparent material.

3. Device according to claim 1 or claim 2, characterized in that the housing element is connected to the front panel by its base wall.

4. Device according to claim 1, characterized in that this device comprises several identical openings, and housing elements and guide elements in numbers equal to that of those openings.

5. Device according to claim 1, characterized in that each opening has a section similar, clearances apart, to the format of the product considered.

6. Device according to claim 1, characterized in that this guide element (5, 55) is made in at least one transparent material.

7. Device according to claim 1, characterized in that this guide element has more or less the same internal section as the opening to which it is connected.

8. Device according to claim 1, characterized in that the pusher has a front surface formed from portions having different inclinations chosen as a function of the format of the product such that the product which is located in the housing element is more or less parallel to the front panel.

9. Device according to claim 8, characterized in that, in the case in which the product has a shape which broadens upwards from a narrow zone, the front surface of the pusher has a portion inclined upwards and rearwards.

10. Device according to claim 1, characterized in that the elastic means is subjected to tensile stress.

11. Device according to claim 10, characterized in that the elastic means comprises at least one spring sheet wound in a spiral engaged in the piston, which runs alongside the guide element and one end of which is fixed at the opening.

12. Device according to claim 10, characterized in that this elastic means comprises a spring sheet the rear end of which is linked to a removable element (95) which can be, if required, hooked either on to the pusher or a rear portion of the guide element.

13. Device according to claim 12, characterized in that this spring sheet is engaged in a block normally resting on the rear of one portion of the pusher, including an extension (96) capable of co-operating with a rear projection (90) of the guide element.

14. Device according to claim 1, characterized in that this elastic means comprises two spring sheets (7', 87) wound in a spiral.

15. Device according to claim 1, characterized in that the pusher is provided with ribs (23, 24, 25, 26, 27, 28) intended to be guided by the guide element.

16. Display unit comprising a plurality of devices according to claim 1, some at least of these devices having front panels of the same dimensions.

* * * * *